United States Patent [19]

Roccaforte

[11] 3,978,980

[45] Sept. 7, 1976

[54] CARTON

[75] Inventor: Harry I. Roccaforte, Western Springs, Ill.

[73] Assignee: Hoerner Waldorf Corporation, St. Paul, Minn.

[22] Filed: June 27, 1975

[21] Appl. No.: 591,103

[52] U.S. Cl. ..... 206/45.14
[51] Int. Cl.[2] ..... B65D 5/50
[58] Field of Search ..... 206/45.14

[56] References Cited

UNITED STATES PATENTS

| | | | |
|---|---|---|---|
| 2,374,006 | 4/1945 | Freel et al. | 206/45.19 |
| 2,571,833 | 10/1951 | Chidsey, Jr. | 206/434 |
| 3,302,778 | 2/1967 | McGorty et al. | 206/45.14 |
| 3,378,135 | 4/1968 | Stone | 206/45.14 |
| 3,419,133 | 12/1968 | Stone | 206/45.14 |
| 3,669,253 | 6/1972 | Hanko | 206/45.14 |
| 3,754,642 | 8/1973 | Stidolph | 206/45.14 |

*Primary Examiner*—Leonard Summer
*Attorney, Agent, or Firm*—Jerry F. Best

[57] ABSTRACT

A display carton and blank for making same which is particularly useful in displaying small rigid tubes where both ends of the tube are engaged by the carton, including a shadow panel arrangement having at one end thereof a three-panel tube engaging arrangement wherein a center panel supports and engages the bottom of the cap and two small triangular panels engage the edges of the bottom of the tube to hold it in position along with the shadow panels.

1 Claim, 7 Drawing Figures

CARTON

BACKGROUND OF THE INVENTION

1. Field of the Invention

This invention relates to designs of display cartons which have shadow panels and are useful for holding small tubular articles.

2. Description of the Prior Art

Rigid tube cosmetic or pharmaceutical containers for use by consumers are shipped and displayed in a variety of paperboard shadow boxes which provide a location for art work and other consumer information and reduce the opportunity for loss due to theft in the store. These display cartons are often of the shadow panel variety and at one end often include an inwardly folded flap with an oval aperture which positively engages one end of the tube to prevent its removal. At the opposite end it is desirable to have means which will engage the tube to prevent its easy removal from the carton by a prospective shoplifter, while at the same time providing an attractive arrangement blending with the shadow panels to hold the tube in position within the carton.

SUMMARY OF THE INVENTION

A shadow display carton for a rigid tube with three flaps at one end to engage the end of the tube, the center flap adapted to support and engage a recessed end of the tube and two adjacent flaps designed to frictionally engage the sides of the tube and blend with the shadow panels.

DETAILED DESCRIPTION OF THE PREFERRED EMBODIMENT

The use of shadow panel display cartons for shipping and storing small articles such as tubes of cosmetics or pharmaceuticals is becoming increasingly popular since there is a greater area on which to print promotional material as well as information which is required by the U.S. Department Of Health. In addition, such cartons make it more difficult for shoplifters to take the relatively small articles which may be on the order of size of a lipstick tube. In the present invention, an article to be displayed 10 is shown having a generally tubular shape with a cap 11 on one end and a serrated finger grip 12 on the opposite end thereof. These are seen best in FIG. 1.

Figure 2:
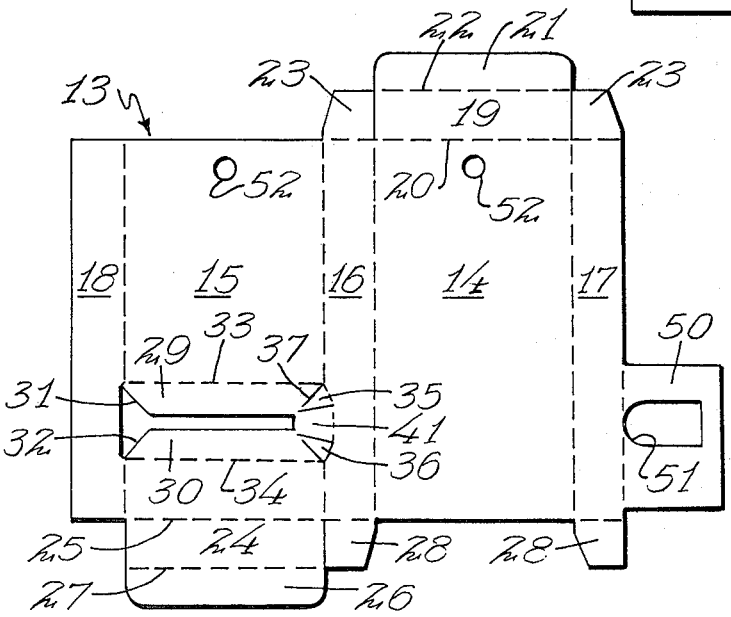
FIG. 2 is a plan view of a blank embodying the features of the present invention and adapted to be folded into a carton such as shown in FIG. 1.

The carton shown generally as 13 is formed from a blank similar to that shown in FIG. 2 and includes a back panel 14, a front panel 15, side panels 16 and 17 along with a manufacturer's glue flap 18, which are positioned at the lateral edges of the front and back panels. Attached to the top and bottom edges of the front end panels are means for closing the ends of the carton 13 which include a main top closure flap 19 attached along the top edge 20 of the back panel 14, the top edge 20 consisting of a fold line, a tuck-in flap 21 attached along the top edge of the flap 19 along a fold line 22 and minor closure flaps 23 connected to the top edges of the side walls 16 and 17 along the fold line 20. The exact configuration of the end closures is variable and is not intended to be restrictive with respect to this invention. A similar closure arrangement may be found attached to the bottom edge of the front panel 15 and includes a main lower closure flap 24 attached along the bottom edge hinge line 25 and a tuck-in flap 26 connected to the main flap 24 along a second fold line 27. Minor closure flaps 28 are connected along the bottom edge of the side panels 16 and 17 along the fold line 25.

Figure 7:
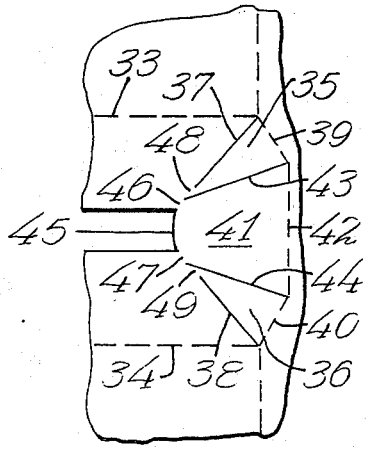
FIG. 7 is an expanded view of a portion of the blank of FIG. 2.

The front panel 15 has formed therein an article receiving opening and shadow panel arrangement which is die cut and includes a pair of shadow panels extending across the width of the front panel 15 which are numbered 29 and 30. At one end of these shadow panels are angled cuts which result in an inwardly facing or sloping edge on each of the shadow panels which are designated as 31 and 32, respectively. The shadow panels are connected along parallel fold lins 33 and 34 and at the opposite end is a die cut section which includes a pair of small triangular members 35 and 36 which are attached to the end of each of the shadow panels 29 and 30 along diagonally extending fold lines 37 and 38, respectively. The triangular members 35 and 36 have a second side which is a fold line and which intersects with the two fold lines 37 and 33 which is labeled 39 and forms the second leg of the triangular member 35. The triangular member 36 has a similar second side defined by the fold line 40 which intersects with the fold lines 38 and 34 as seen best in FIG. 7.

A center support member 41 is a trapezoidal member having a base defined by the fold line 42 which is parallel to the lateral edge of the front panel 15, and two angled sides which are shown as 43 and 44 along with a curved edge 45 which curve is generally the same as the interior of the recessed end 12 of the tube 10. The support member 41 is connected to the shadow panels 29 and 30 by small nicks 46 and 47 which hold the support member in position during the manufacturing and gluing process by the carton manufacturer. As will be seen later, these nicks are later broken and the support member 41 folded inwardly to engage the end of the tube 10. The lines designated as 37 and 38 which form one side of the small triangular members 35 and 36 may be hinge lines or may be line cuts as shown with small nicks 48 and 49 toward the narrow end of the triangular members. If the carton 13 is relatively large and as a result the proportioning of the members cause sufficient flexibility in the material which is used, then fold lines may be employed at this point. If the material is very stiff or if the article is very small and the dimensions of these respective sections are very small, then to obtain the necessary flexibility it may be advisable to use a line cut as shown so that the small triangular members 35 and 36 may be moved inwardly without undue distortion of the carton in that area.

Figure 1:
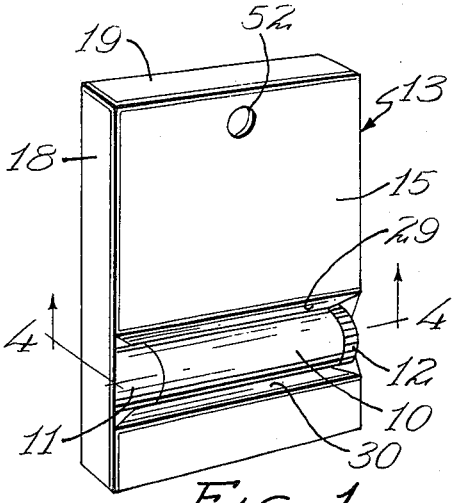
FIG. 1 is a prospective view of a carton embodying the present invention and containing a tube to be displayed.
Figure 4:
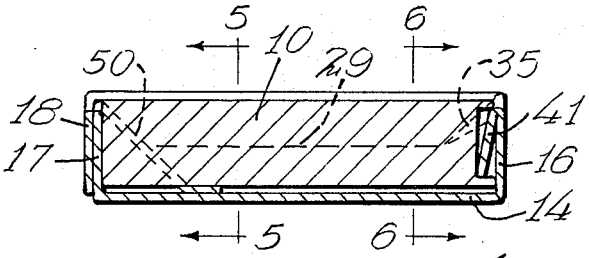
FIG. 4 is a view of the carton and tube shown in FIG. 1, taken along section lines 4—4 in FIG. 1.
Figure 5:
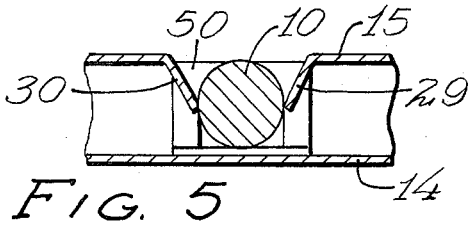
FIG. 5 is a sectional view taken along section lines 5—5 in FIG. 4.
Figure 3:
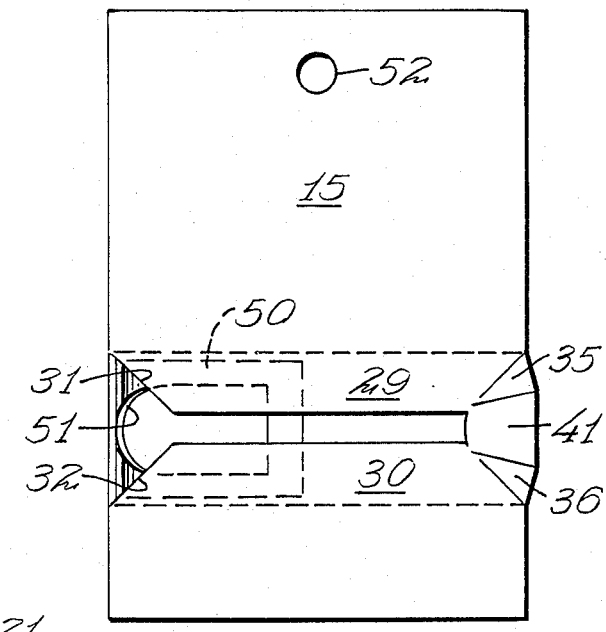
FIG. 3 is a front elevation view of the carton such as shown in FIG. 1 but without a tube therein and illustrating the relationship between the prospective flaps forming the shadow panel area in the carton.

Attached to the side wall panel 17 is a die cut member 50 which has an arcuate opening 51 die cut therein, the relative position of which may be seen best in FIGS. 3 and 4 and serves to engage and retain the cap end 11 of the tube 12. This arrangement is similar to that which may be found in the prior art such as U.S. Pat. No. 3,360,118 to Hansen et al or U.S. Pat. No. 3,302,778 to McGorty et al and U.S. Pat. No. 3,482,678 to Mason. As can be seen in FIG. 1, this arrangement provides a positive restraint for the end of the tube 10 and makes it difficult to pull the tube 10 out of the carton 13 without ripping or distorting the carton.

Figure 6:
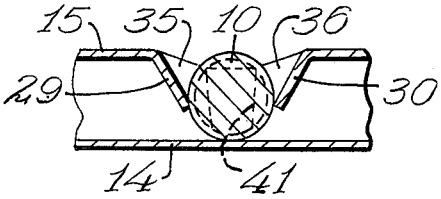
FIG. 6 is a view similar to FIG. 5, taken along section lines 6—6 in FIG. 4, the view being in the opposite direction.

The tube 10 is inserted into the carton 13 by angling the end of the tube 11 behind the curved portion of the aperture 51 and then pushing the remainder of the tube down into contact between the shadow panels 29 and 30 which simultaneously breaks the nicks 46 and 47 attaching the center support member 41 and likewise deflects the center support member 41 inwardly into position so that the edge 45 engages the recessed end of the grip 12 such as seen best in FIG. 6. The triangular shaped members 35 and 36 are moved along with shadow panels 29 and 30 into an attractive position lying in angular relatonship to the shadow panels. The edges 43 and 44 of the triangular members 35 and 36 engage the round edge of the edge 12 of the tube 10, which may have serations or a grippable surface thereon which serves to hold the tube 10 in position.

I claim:

1. In a display carton for a cylinder or tube, said carton being rectangular in shape and having parallel front and back panels and two parallel side panels with a die cut section formed in said front panel, said section including two parallel shadow panels defined by hinge lines and extending the length of said die cut section and separated from each other, and means at one end of said die cut section adjacent a first side panel of said carton for engaging and restraining a first end of said tube, an improved die cut section in said front panel for supporting the end of said tube opposite said first end, said improved section comprising:

a center support member connected to a second side panel along a hinge line perpendicular to said shadow panels, said support member having die-cut sides and a fourth rounded edge opposite said hinge line, said member connected to said shadow panels by a nick at each end of said fourth rounded edge;

a triangular member positioned between each of the sides of said support member and said shadow panels, said triangular members connected to said second side panel along hinge lines extending between the ends of said hinge line connecting said support member and the point of intersection of the lateral edge of said front panel and said triangular members connected to said shadow panels to said front panel, said triangular members connected to said shadow panels by at least a nick near the ends of said fourth rounded edge.

* * * * *